US006182949B1

(12) United States Patent
Mobbs

(10) Patent No.: US 6,182,949 B1
(45) Date of Patent: Feb. 6, 2001

(54) COMBINATION CARBONATOR, SODA PUMP AND WATER AGITATOR

(75) Inventor: Nigel Mobbs, Hinton Cross (GB)

(73) Assignee: IMI Cornelius Inc., Anoka, MN (US)

( * ) Notice: Under 35 U.S.C. 154(b), the term of this patent shall be extended for 0 days.

(21) Appl. No.: 09/203,111

(22) Filed: Nov. 30, 1998

(30) Foreign Application Priority Data

Nov. 29, 1997 (GB) ..... 9725226

(51) Int. Cl.[7] ..... B01F 3/04

(52) U.S. Cl. ..... 261/34.1; 261/84; 261/119.1; 261/DIG. 7

(58) Field of Search ..... 261/34.1, 84, 93, 261/119.1, 121.1, DIG. 7; 222/129.1

(56) References Cited

U.S. PATENT DOCUMENTS 2,463,975 * 3/1949 Johnson ..... 261/93
4,629,589 * 12/1986 Gupta et al. ..... 261/34.1
4,764,315 * 8/1988 Brusa ..... 261/DIG. 7
5,160,461 * 11/1992 Burrows ..... 261/DIG. 7
5,715,700 * 2/1998 Credle, Jr. ..... 222/129.1

FOREIGN PATENT DOCUMENTS

506758 * 11/1951 (BE) ..... 261/93

* cited by examiner

*Primary Examiner*—Duane Smith
*Assistant Examiner*—Robert A. Hopkins
(74) *Attorney, Agent, or Firm*—Sten Erik Hakanson

(57) ABSTRACT

A combined agitator (30), carbonator (10) and soda pump arrangement (23, 24) for dispensing beverages uses a magnetic drive coupling (28, 29). The carbonator coolant tank (15) in which the agitator (30) works has an optional ice bank chiller (20).

12 Claims, 1 Drawing Sheet

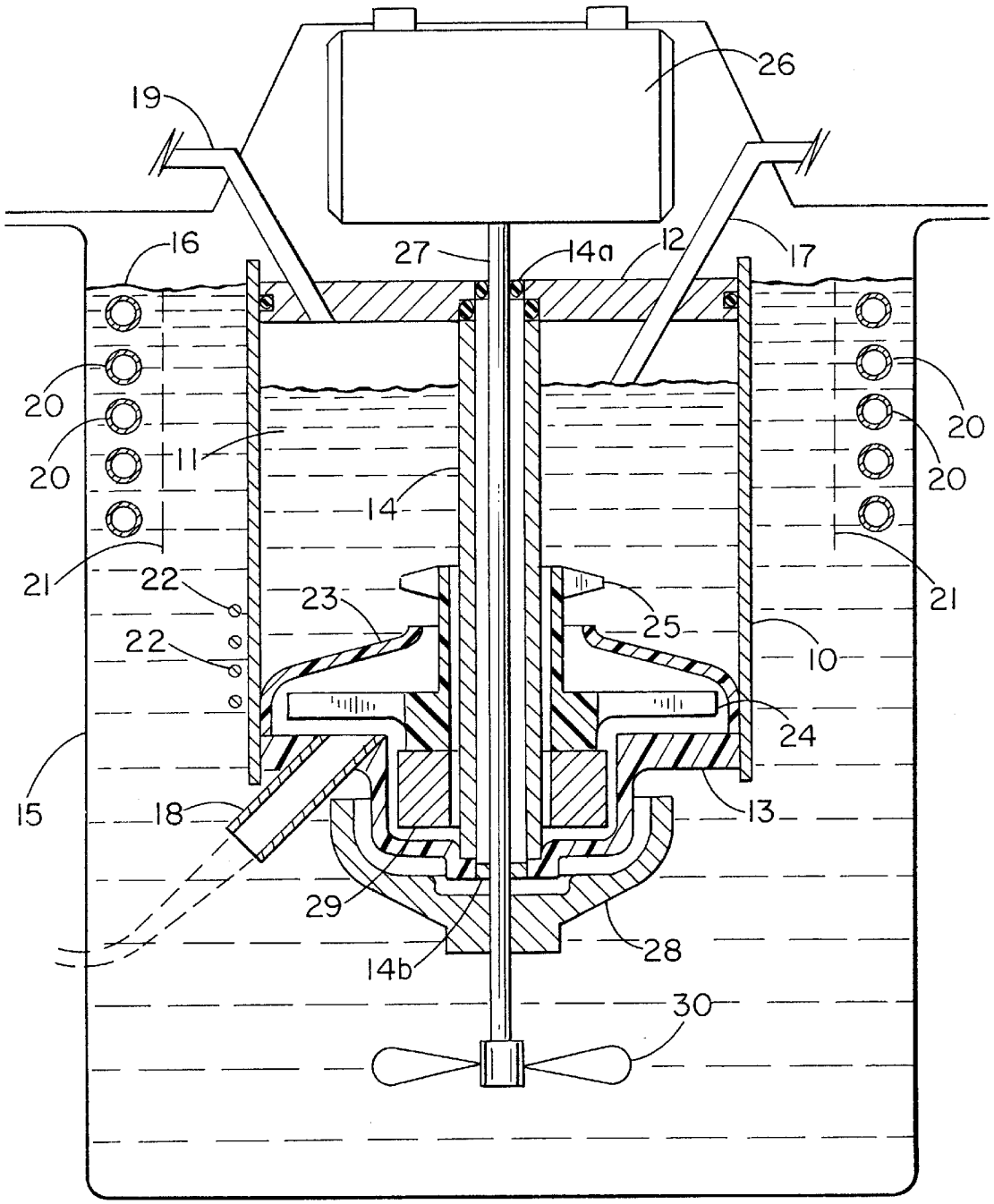
26
19
16
27
14a
12
17
20
20
11
14
20
20
21
22
23
25
21
22
10
24
15
18
13
29
28
14b
30

COMBINATION CARBONATOR, SODA PUMP AND WATER AGITATOR

FIELD OF THE INVENTION

The present invention generally concerns beverage dispensing equipment and in particular such equipment having a combined agitator, carbonator and soda pump arrangement using a magnetic drive coupling.

BACKGROUND OF THE INVENTION

Beverage dispensing equipment relative to the provision of carbonated beverages is well understood. Such beverages may include a syrup mixed with carbonated water (also known as soda). Such equipment which provides for such beverages typically have associated with them a carbonator for mixing carbon dioxide gas with water. The carbonator body may have surrounding it a reservoir containing a chilled coolant. For example, the carbonator may be located within an ice bank cooled water bath which chills the carbonator and its contents as well as the water to be carbonated. As is known, the ice bank is formed on an evaporator located with the water bath which evaporator is cooled by the operation of a mechanical refrigeration system. Examples of such arrangements are described in GB 2 307 975A and U.S. Pat. No. 5,399,300.

In practice, the carbonator may be closely adjacent to or remote from the beverage dispense point i.e., the point where a valve or tap is operated to dispense the beverage into a glass or similar container from which the consumer will drink the beverage. If the carbonator is remote from the dispense point, the soda may be kept chilled on its journey from the carbonator by ensuring that the supply tube is held within a thermally insulating sleeve which is sometimes known as a python.

A continuing problem with prior art carbonators concerns their ability to rapidly form carbonated water of the desired level of carbonation to adequately provide for needed volumes thereof during periods of high drink demand.

A further problem concerns the ability of the cooling equipment to provide for good heat exchange between the ice bank and the carbonator tank and the water or syrup coils wherein the water in the bath serves as the thermal exchange medium there between. Typically, agitators are used to stir the water in the bath tank to ensure proper heat exchange between the water and the ice bank and, in turn, the carbonator and coils. However, an agitator includes a separate motor and presents further equipment and energy consumption cost.

Carbonators also require a water pump to pump the flat or non-carbonated water therein and to pump the carbonated water therefrom to the dispense point. Such pumps also represent further cost and complexity.

Accordingly, it would be desirable to have an improved carbonator that can produce large volumes of properly carbonated water. And it also would be desirable to accomplish the foregoing in a manner that provides for good heat exchange between the carbonator and the cooling medium there around and do so in a manner that is cost efficient. It would further be desirable to provide for such heat exchange and for the pumping of water to and from the carbonator that does not require separate motors for each such function.

BACKGROUND OF THE INVENTION

According to one aspect of the invention, a carbonator is provided for use in beverage dispense, said carbonator comprising:

means for retaining a first liquid to be carbonated, said retaining means essentially comprising a closed tank having associated an entry for said first liquid and an associated exit for said first liquid when carbonated;

means for admitting carbon dioxide gas under pressure into said retaining means; pump means for said first liquid located within said retaining means, said pump means having drive means located externally of said retaining means, said pump means being driven via a magnetic coupling between the pump means and the drive means;

a reservoir in which said retaining means is located, said reservoir being adapted to hold a second liquid which surrounds at least part of said retaining means, and agitation means located below the retaining means for agitating said second liquid, said agitation means being directly connected with the said drive means.

A passageway may be provided through the retaining means through which passes a shaft extending from the drive means to the agitation means. The drive means may be located above the retaining means. The magnetic coupling between the pump means and the drive means may comprise two components, one of which is within the retaining means and coupled with the pump impeller, with the other component extending within the reservoir below the retaining means. This second component is typically attached to the lower portion of the shaft. The agitation means for the second liquid is typically located on said shaft below said latter component of the magnetic coupling. Means may be provided attached to the pump impeller for agitating the first liquid within the retaining means.

Optionally, the reservoir may contain means for chilling the second liquid. Such chilling means may include the evaporator portion of a refrigeration circuit. The evaporator may be in the form of a coiled tube which extends around the inside perimeter of the reservoir. The refrigeration system may be adapted to create and maintain an ice bank around the inside perimeter of the reservoir. Alternatively, the second liquid may be recirculated through a python to a remote chiller from where the second liquid is returned to the reservoir. The reservoir may be of a depth which substantially enables the retaining means to be covered with the second liquid or for the liquid to extend over a substantial portion of the external surface area of the retaining means. Within the reservoir there may be means for circulating a further liquid product and maintaining said further product chilled. Such further product could include a fruit or cola syrup.

DESCRIPTION OF THE DRAWING

A more thorough understanding of the structure, function, operation, objects and advantages of the present invention can be had by reading the following detailed description of the preferred embodiment which refers to the following drawing:

FIG. 1 shows a schematic elevation partly in cross-section of f the carbonator of the present invention.

DETAILED DESCRIPTION OF THE PREFERRED EMBODIMENT

One embodiment of the invention will now be described, by way of example only, with reference to the accompanying FIG. 1. A carbonator of the present invention for use with an associated beverage dispenser has a carbonator body 10 of cylindrical shape and made from stainless steel. The carbonator body has an upper end cap 12 and a lower end cap 13 which together with the body 10 provide means for retaining a body of water 11 which is being carbonated. The lower end cap 13 is made of non-ferromagnetic material e.g. a plastics moulding, and the assembly is made pressure tight to accommodate the required degree of carbonation. Upper end cap 12 can also be made of plastic, as seen in U.S. Pat. No. 5,792,391, which patent is incorporated herein by reference thereto, and both caps 12 and 13 can be secured to carbonated body cylinder 10 as seen therein.

A central passageway having an annular wall 14 and a top fluid tight shaft seal 14*a* and a bottom fluid tight shaft seal 14*b*, extends vertically through the carbonator body 10. The carbonator body 10 is located within a coolant reservoir 15, the coolant typically being glycol or water based. The level of the coolant is shown by numeral 16.

The carbonator body 10 has entry means 17 to enable fresh water to pass into the carbonator. An exit 18 for carbonated water extends through the wall of the lower end cap 13 and has tubing (shown schematically by dashed lines) which takes the carbonated water from the carbonator and transfers it to one or more associated beverage dispensers. A carbon dioxide gas inlet 19 is provided in the upper end cap 12 whereby carbon dioxide gas under pressure may be admitted into the carbonator body and into the water 11 retained within said body 10.

As seen in FIG. 1, an optional evaporator 20 is used to chill and/or freeze the coolant adjacent the inner walls of reservoir 15. This may create an ice bank whose inner perimeter is illustrated in dashed line at 21. Optional product coils 22, through which syrups or colas may pass and be chilled, are shown extending within the coolant in the reservoir 15.

Within the annular carbonator body 10 is a pump housing 23 which is co-axial with central passageway 14. Within pump housing 23 is a pump impeller 24, again co-axial with central passageway 14, which may be driven to pump soda water from carbonator body 10 via exit 18. A vane 25 is attached to the pump impeller 24 so that it rotates with it to agitate the water 11 within carbonator body 10 to assist in the absorption of carbon dioxide. The pump impeller 24 is driven indirectly by a motor 26 positioned above the carbonator body 10. A drive shaft 27 extends downwardly from motor 26 through central passageway 14 and through dynamic seals 14*a* and 14*b* to below the level of the lower end cap 13. The indirect driving means is provided by magnetic drive components 28 and 29, first component 28 of which is attached to drive shaft 27 and extends radially therefrom closely adjacent to and below the bottom surface of the lower end cap 13. The second component 29 of the magnetic drive means extends annularly and is free to rotate within carbonator body 10 closely adjacent the upper surface of the lower end cap 13. The pump impeller 24 is attached to the second magnetic drive component. The principles of operation of such magnetic drives are well known.

An agitator 30 for the second liquid, namely the coolant within reservoir 15, is attached to the remote end of drive shaft 27 such that the agitator 30 is below the level of the first magnetic drive component 28. Agitator 30 serves to homogenise the coolant and avoid stratification of such coolant into zones of differing temperature. It also serves to move the coolant relative to the surface of an ice bank when such is present within the reservoir and also to ensure that syrup within tubes 22 is maintained at a substantially constant temperature.

In operation, motor 26 operates to drive shaft 27 and to directly drive agitator blade 30 secured thereto. Rotation of shaft 27 also rotates magnetic drive component 28, which then imparts rotation to drive component 29. Drive component 29 then causes rotation of impeller 24 and agitator 25 attached thereto. The water in carbonator 10 is then carbonated by the mixing action of agitator 25 and is also pumped therein along line 17 and therefrom along line 18 by the action of impeller 24. Thus, those of skill will appreciate that carbonator 10 can provide for agitation of the heat exchange fluid there around and for the agitation of the water and therein as well as for the necessary pumping of water therein and carbonated water there from through the use of a single motor 26.

What is claimed is:

1. A carbonator for use in beverage dispense, said carbonator comprising:

means for retaining a first liquid to be carbonated, said retaining means essentially comprising a closed tank having associated an entry for said first liquid and an associated exit for said first liquid when carbonated;

means for admitting carbon dioxide gas under pressure into said retaining means;

pump means for said first liquid located within said retaining means, said pump means having drive means located externally of said retaining means, said pump means being driven via a magnetic coupling between the pump means and the drive means;

a reservoir in which said retaining means is located, said reservoir being adapted to hold a second liquid which surrounds at least part of said retaining means, and agitation means located below the retaining means for agitating said second liquid, said agitation means being directly connected with the said drive means.

2. A carbonator as claimed in claim 1 in which a passageway is provided through the retaining means through which passes a shaft extending from the drive means to the agitation means.

3. A carbonator as claimed in claim 1 in which the drive means is located above the retaining means.

4. A carbonator as claimed in claim 1, 2 or 3 in which the magnetic coupling between the pump means and the drive means comprises two components, one of which is within the retaining means and coupled with the pump impeller.

5. A carbonator as claimed in claim 4 in which the second component extends within the reservoir below the retaining means.

6. A carbonator as claimed in claim 1 in which the reservoir contains means for chilling the second liquid.

7. A carbonator as claimed in claim 1 in which the second liquid is recirculated from the reservoir via a remote chiller.

8. A carbonator as claimed in claim 7 including means located within the reservoir for carrying a further liquid product such as a syrup.

9. A carbonator as claimed in claim 2 in which the drive means is located above the retaining means.

10. A carbonator for use in beverage dispense, said carbonator comprising:

a closed tank having a carbon dioxide gas inlet, a flat water inlet and a carbonated water outlet; and the closed tank having a central shaft passage extending there through between a closed tank top end and a closed tank bottom end and the closed tank top end having a top dynamic shaft seal extending around a perimeter of a top end opening of the passage and the closed tank bottom end having a bottom dynamic shaft seal extending around a perimeter of a bottom opening of the passage, and the closed tank having an interior volume, a shaft extending through the central shaft passage having a drive end extending from the tank top end for securing to a drive motor and a driven end extending from the tank bottom end, a fluid pump having an impeller retained within an impeller housing and the impeller and impeller housing retained within the tank interior volume, a first magnetic drive component retained within the tank interior volume and secured to the impeller and the first magnetic drive component and impeller rotatively mounted around the central shaft passage adjacent the closed tank bottom end, a second magnetic drive component exterior of the tank and adjacent the bottom end thereof and secured to the shaft driven end so that rotation of the shaft by the drive motor drives the impeller.

11. The carbonator as defined in claim 10, and the shaft driven end also having an exterior agitator blade secured thereto.

12. The carbonator as defined in claim 10, and the shaft having an interior agitator blade secured thereto.

* * * * *